US006035443A

United States Patent [19]

Green

[11] Patent Number: 6,035,443

[45] Date of Patent: Mar. 14, 2000

[54] EXPOSED PALM GOLF GLOVE FOR COVERING SELECTED FINGERS OF A GOLFER

[75] Inventor: Stanley L. Green, 23238 Firwood, Eastpointe, Mich. 48021

[73] Assignees: Stanley L. Green, Eastpointe; Peter D. Keefe, Roseville, both of Mich.

[21] Appl. No.: 09/275,459

[22] Filed: Mar. 24, 1999

[51] Int. Cl.[7] ..... A41D 19/00

[52] U.S. Cl. ..... 2/161.2; 2/161.4; 2/161.5; 2/163; 2/907; 473/205

[58] Field of Search ..... 2/16, 159, 161.1, 2/161.2, 161.4, 161.6, 161.5, 163, 907, 917; 473/59, 205, 450, 615

[56] References Cited

U.S. PATENT DOCUMENTS

| | | | |
|---|---|---|---|
| 1,479,771 | 1/1924 | Campbell . | |
| 1,483,595 | 2/1924 | Read . | |
| 2,317,227 | 4/1943 | Sherwood | 2/159 |
| 2,700,159 | 1/1955 | Van Denburgh . | |
| 2,769,179 | 11/1956 | Love | 2/159 |
| 2,949,610 | 8/1960 | Lutsky | 2/161 |
| 2,975,429 | 3/1961 | Newman . | |
| 4,025,962 | 5/1977 | Hartung | 2/161 |
| 4,064,563 | 12/1977 | Stokes | 2/161 |
| 4,573,220 | 3/1986 | Baker | 2/161 |
| 4,575,075 | 3/1986 | Tarbox et al. . | |
| 4,813,079 | 3/1989 | Reitzel . | |
| 4,882,787 | 11/1989 | Hull et al. | 2/161 |
| 5,423,089 | 6/1995 | Chun et al. . | |
| 5,628,068 | 5/1997 | DeLong | 2/161.1 |
| 5,873,788 | 2/1999 | Hoffman . | |

OTHER PUBLICATIONS

ULTRA FLEX (TM) golf glove product of Wilson Sporting Goods Co., Chicago, IL 60631; undated, believed on sale for more than one year prior to Mar. 24, 1999.

*Primary Examiner*—Diana Oleksa
*Assistant Examiner*—Katherine Moran
*Attorney, Agent, or Firm*—Peter D. Keefe

[57] ABSTRACT

A palmless golf glove which allows for a normal grip stance of the golf club, chaffing protection for at least the second and third fingers, prevention of slippage and full palm tactility. The palmless golf glove includes a body section for covering a selected portion of the back (anterior) of the hand but not any of the palm of the hand, at least second and third finger receptacles connected to a forward end of the body section, and a wrist band for anchoring the palmless golf glove to the hand without slippage. In the preferred embodiment, the palmless golf glove includes finger receptacles for selected fingers and a body section that completely exposes the palm. The wrist band is connectably operated by a VELCRO (trademark of Velcro, USA) and includes a notch which exposes the styloid process of the wrist. By exposing the palm completely, tactility is maximized. By exposing the ball of the wrist articulative movement is maximized.

20 Claims, 7 Drawing Sheets

EXPOSED PALM GOLF GLOVE FOR COVERING SELECTED FINGERS OF A GOLFER

BACKGROUND OF THE INVENTION

1. Field of the Invention

The present invention relates to gloves, particularly gloves used for playing the game of golf. More particularly, the present invention relates to a palmless glove having selected finger receptacles wherein the glove is attachable to the wrist of the hand and, in its preferred form, only the fingers subject to golf swing induced chaffing are covered thereby, resulting in piece of mind for the golfer so that his/her attention to swing is not diverted by thoughts of impending finger chaffing, while tactile feel maintained so that control over the swing is maximized.

2. Description of the Prior Art

The game of golf involves great concentration when making a swing so that the ball will be struck square with the face of the head of the golf club with certainty, resulting in distant and directed travel of the golf ball. However, it is a well known impediment to the game of golf that the fingers can become chafed by repetitious swings. Such chaffing can result in undesirable callus or blister development in a worst case scenario. In any event, the distraction of finger chaffing causes a golfer's thoughts to wander thereto and this steals away the mental concentration needed to keep his/her stroke score as low as possible. In this regard, the posterior of the primary hand, that is the right hand of a right handed person or the left hand of a left handed person is subject to chaffing generally at the second and third fingers, and for some golfers, the first finger. In this regard further, the posterior of the secondary hand, that is, the left hand of a right handed person or the right hand of a left handed person is subject to chaffing generally at the second, third, and fourth fingers.

In the golf art it is known to wear gloves in order to protect the fingers from chaffing. However, this creates another problem. Many golfers tend to hold onto the golf club too tightly, and gloves tend to cause a lack of tactility (sensation) which only exacerbates this problem.

Accordingly, what remains urgently needed in the golf art is a golf glove which provides chaffing protection where it is needed, yet provides full palm tactility.

SUMMARY OF THE INVENTION

The present invention is a palmless golf glove which allows for a normal grip stance of the golf club, chaffing protection for selected fingers, prevention of slippage, full palm tactility and grip relaxation.

The palmless golf glove according to the present invention includes a body section for covering a selected portion of the back (anterior side) of the hand but not any of the palm of the hand (at the posterior side of the hand), at least second and third finger receptacles connected to a forward end of the body section, and a wrist band connected to a lower end of the body section for wrapping around the wrist of the hand to thereby anchor the palmless golf glove to the hand without slippage.

In a first preferred embodiment, the palmless golf glove includes finger receptacles for the second and third fingers and a body section that not only completely exposes the palm, but also completely exposes the thumb, the first (index) finger and the fourth (pinky) finger. The wrist band is connectable operated by a two component fastener, such as VELCRO (trademark of Velcro, USA) and includes a notch which exposes the styloid process of the ulnar bone, sometimes referred to as the ball of the wrist.

In a second preferred embodiment, a palmless golf glove is provided wherein the first, second and third fingers are provided with a respective finger receptacle; the palm, thumb and fourth finger are completely exposed.

In a third preferred embodiment, a painless golf glove is provided wherein the first, second, third and fourth fingers are provided with a respective finger receptacle, and the thumb is also provided with a thumb receptacle; the palm is completely exposed.

In a fourth preferred embodiment, a palmless glove is provided wherein the second, third and fourth fingers are provided with a respective finger receptacle; the palm, thumb and first finger are completely exposed.

In a preferred method of using the painless golf glove, the primary hand (right hand for a right handed person, left hand for a left handed person) wears either the first or the second preferred embodiment of the palmless golf glove, and the secondary hand (left hand of a right handed person, right hand of a left handed person) wears either the third or fourth preferred embodiment of the palmless golf glove.

By exposing the palm, tactility is maximized for a wearer of the palmless golf glove, thus reducing the golfer's tendency to too tightly grip the golf club. By exposing the styloid process, articulative movement of the hand at the wrist is maximized. By covering only as many fingers as are subjected to chaffing, the golfer has piece of mind, and the resulting tactility and mobility combine to ensure the golfer's concentration is completely on the swing and not any circumstances distractingly related to his/her hand.

Accordingly, is is an object of the present invention to provide a palmless golf glove which covers selected fingers and completely exposes to palm for enhanced tactile sensation.

It is an additional object of the present invention to provide a palmless golf glove as described which provides anchorage to the hand so that slippage will not occur.

It is yet a further object of the present invention to provide a golf glove as described which exposes the styloid process for enhancement of articulative mobility of the hand during a golf swing.

It is still a further object of the present invention to provide a golf glove as described which fully exposes the thumb for a further enhancement of tactility.

It is still another object of the present invention to provide a palmless golf glove which covers selected fingers and completely exposes to palm for enhanced tactile sensation so as to thereby reduce a golfer's tendency to grip the golf club too tightly.

These, and additional objects, advantages, features and benefits of the present invention will become apparent from the following specification.

DETAILED DESCRIPTION OF THE PREFERRED EMBODIMENTS

Figure 1:
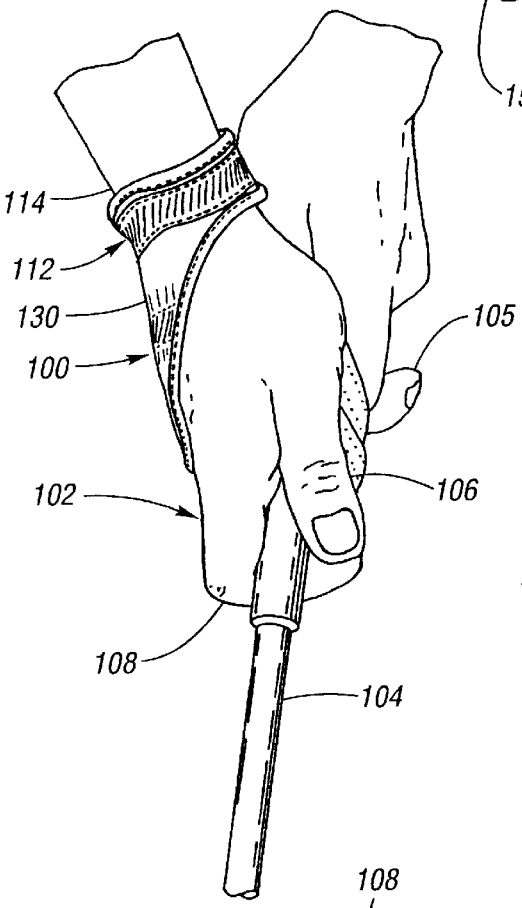
FIG. 1 is a perspective view of a first embodiment of the palmless golf glove, shown in operation on the right hand of a right handed golfer whose left hand is bare, wherein the golfer is gripping a golf club.
Figure 2:
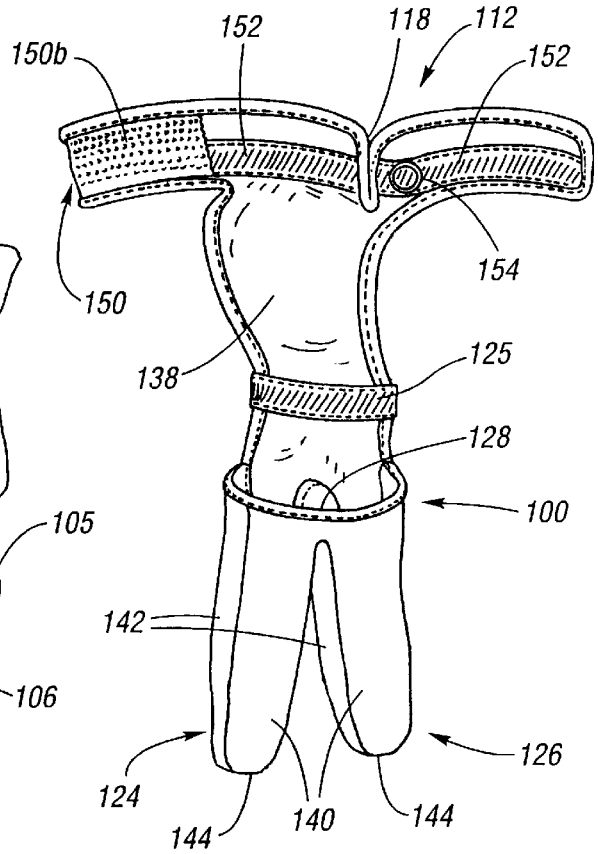
FIG. 2 is a posterior plan view of the first embodiment of the palmless golf glove.
Figure 3:
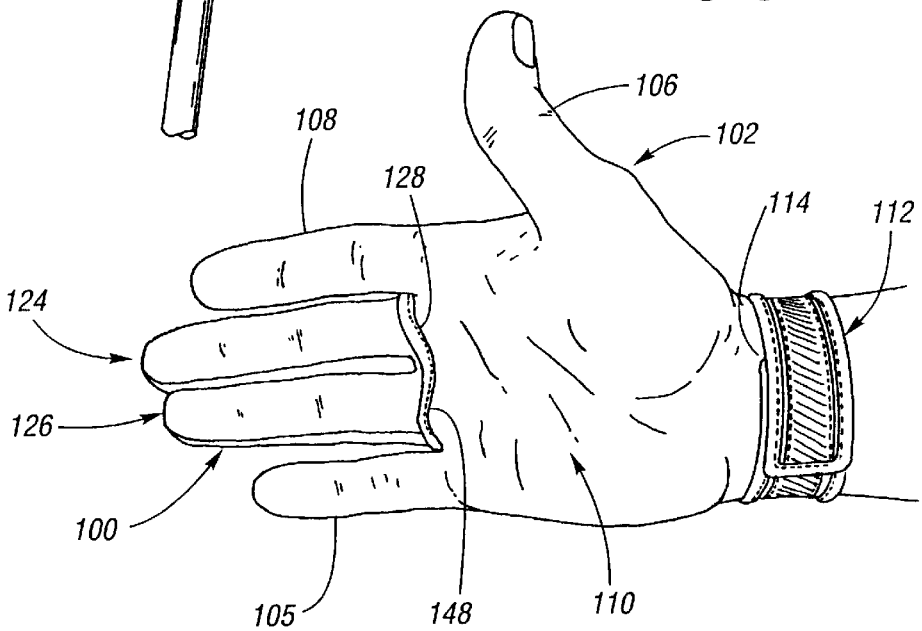
FIG. 3 is an anterior plan view of the first embodiment of the palmless golf glove, shown being worn on a right hand.
Figure 4:
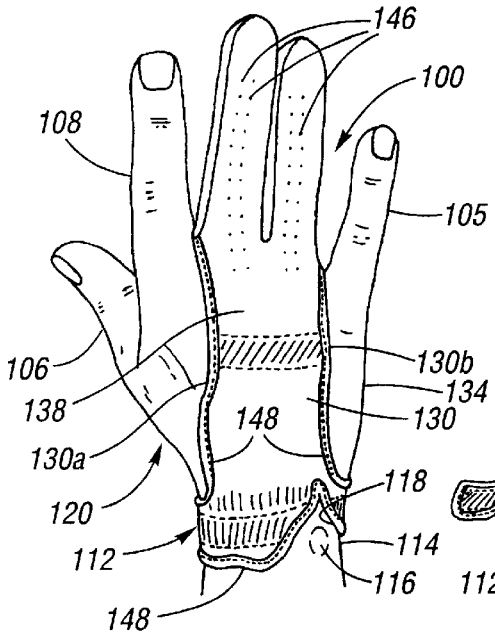
FIG. 4 is an anterior plan view of the first embodiment of the palmless golf glove, shown being worn on a right hand.

Referring now to the Drawing, the general operational and structural features of a first embodiment of the palmless golf glove 100, 100' according to the present invention can be discerned from simultaneous reference to FIGS. 1 through 7, 11 and 12. The palmless golf glove 100 is shown being worn by a right hand 102 of a golfer, wherein a golf club 104 is being gripped by both hands of the golfer. It will be seen that the palmless golf glove 100 fully exposes the thumb 106, the first (index) finger 108, the fourth (pinky) finger 105, and, as can be discerned from FIG. 7, the palm 110 of the right hand is fully exposed, as well. Still further, it will be seen at FIGS. 1 and 7 that a wrist band 112 securely engirds the wrist 114 so that the palmless golf glove 100 cannot slip off from the hand 102. As indicated at FIG. 4, the styloid process 116 of the wrist 114 is exposed via a notch 118 formed in the wrist band 112, thereby aiding free articulative movement of the wrist even when the wrist band is tightly engirding with respect thereto.

It will be appreciated from FIG. 3 that the palmless golf glove 100 provides ample and protective coverage of the second and third fingers via respective second and third finger receptacles 124, 126, wherein these second and third finger receptacles have a basal terminus 128 which is located at the base of the fingers where the palm 110 begins.

It will additionally be appreciated from FIGS. 2 and 4 that the second and third finger receptacles 124, 126 are connected to the wrist band 112 via a body section 130 which partly covers the back 132 of the hand 102, leaving the end 134 of the hand, thumb 106, first (index) finger 136, fourth (pinky) finger 105, and palm 110 all completely exposed, thereby enhancing tactility and motor function of the hand.

Now with greater specificity, the structural aspects of the palmless golf glove 100 will be detailed.

The body section 130, second and third finger receptacles 124, 126 and the wrist band 112 are constructed of a suitable glove material, preferably a very soft, supple leather with a fabric inner lining, as for example a microfiber lining. In a preferred mode of manufacture, as shown at FIG. 2, a first glove member 138 provides the body section, the anterior of the second and third finger receptacles, and the wrist band 112; a second glove member 140 provides the posterior of the second and third finger receptacles, wherein a wedge shaped glove member 142 is sewed on either side of each of the second and third finger receptacles to provide conjoinder of the first and second members so as to form the second and third finger receptacles 124, 126.

In regard the second and third finger receptacles 124, 126, it is preferred for these to be closed at their respective distal tips 144, but this is not a requirement—the distal tips may be truncatedly open so long as the chaffing experiencing portions of a golfers fingers are protectively covered. As shown at FIG. 2, it is further preferred to provide a multiplicity of small holes 146 in the first glove member 138 along the second and third finger receptacles so that hand sweating thereinside is minimized.

As shown at FIGS. 3 and 4, a hem 148 is preferably provided at the basal terminus 128, along the sides 130*a*, 130*b* of the body section 130 and the wrist band 112. The hem 148 is preferably in the form of a folded-over trim piece, such as for example leather, which is sewed onto the respective glove members as are situated therealong.

As shown at FIG. 2, it is preferred to include an elastic material 125 stitched to the posterior side of the glove body 138 so as to thereby provide a built-in stretch of the glove body between the finger receptacles and the wrist band 112 when the golfer makes a fist. For example, a stitch provides a pucker in the glove body, which pucker is selectively taken-out when the golfer makes a fist. It is preferred for the elastic material to be located other than at the knuckles for hand comfort, although a soft feeling elastic material could be placed at the knuckles.

Figure 5:
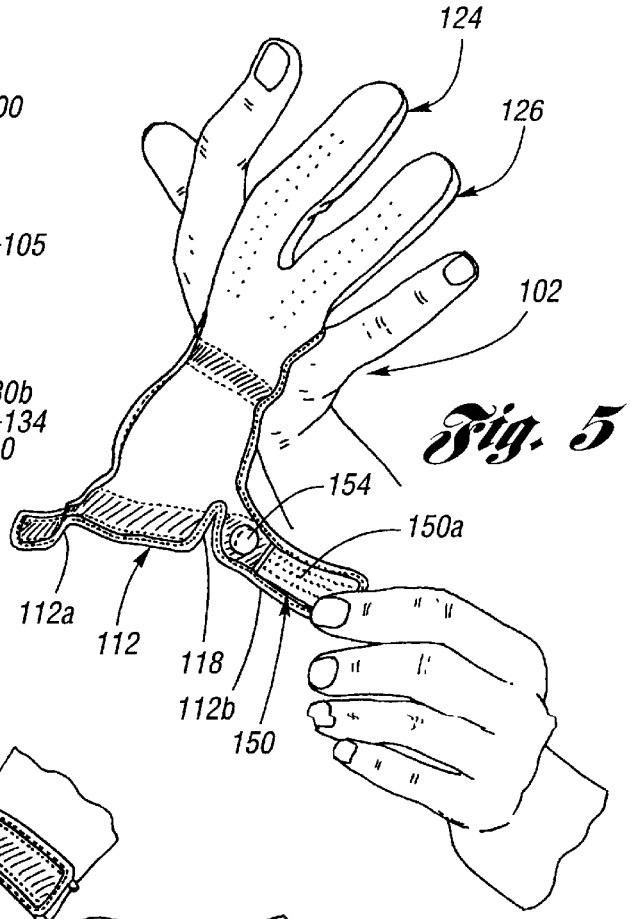
FIG. 5 is a perspective view showing an intermediate stage of putting the first embodiment of the palmless golf glove onto a right hand.

As shown at FIGS. 2 and 5, the wrist band 112 is composed of first and second portions 112*a*, 112*b* which are affixed at one end thereof to the body section 130, and are free at their respective opposite ends. At each of these free ends is located a respective component of a two component releasable fastener 150, as for example a hook component 150*a* and the loop component 150*b* of VELCRO. The two component releasable fastener 150 allows the user to self-adjust the tightness of engirding about his or her wrist. It is preferred for the wrist band 112 to include an elastic material 152 to be stitched to thereto so as to thereby provide a built-in stretch of the wrist band 112, as for example the stitch providing a pucker in the wrist band, which pucker is selectively taken-out when the wrist band is wrapped selectively tightly around the wrist. The notch 118 accommodates exposure of the styloid process of the wrist, as explained above, without compromising the ability of the wrist band to engird the wrist in a secure manner to prevent slippage. It is preferred to include a conventional ball marker button 154 at the wrist band 112.

Figure 6:
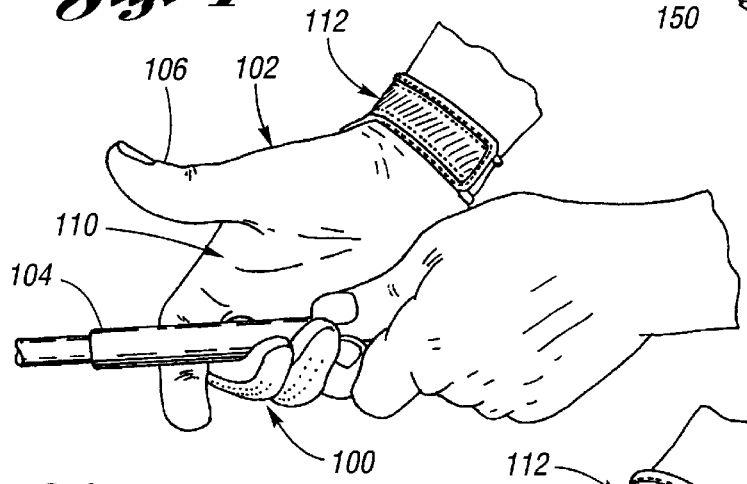
FIG. 6 is a perspective view of the first embodiment of the palmless golf glove shown at an intermediate stage of operation with respect to grippage of a golf club.
Figure 7:
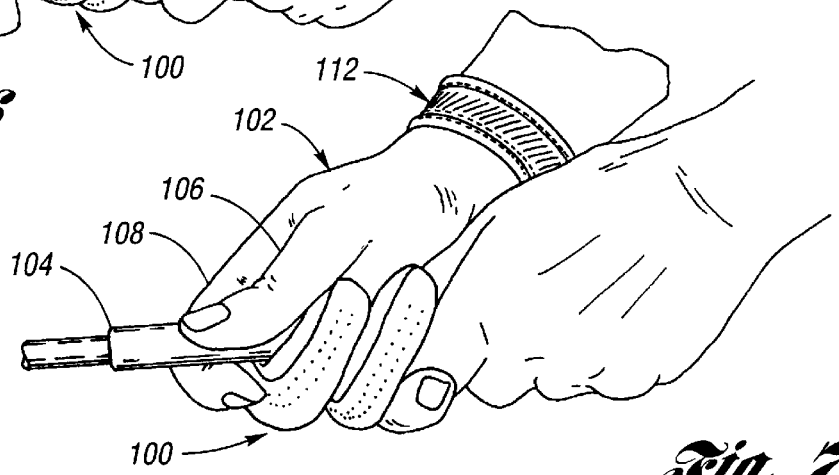
FIG. 7 is a second perspective view of the first embodiment of the palmless golf glove, shown in operation on the right hand of a right handed golfer whose left hand is bare, wherein the golfer is gripping a golf club.
Figure 8:
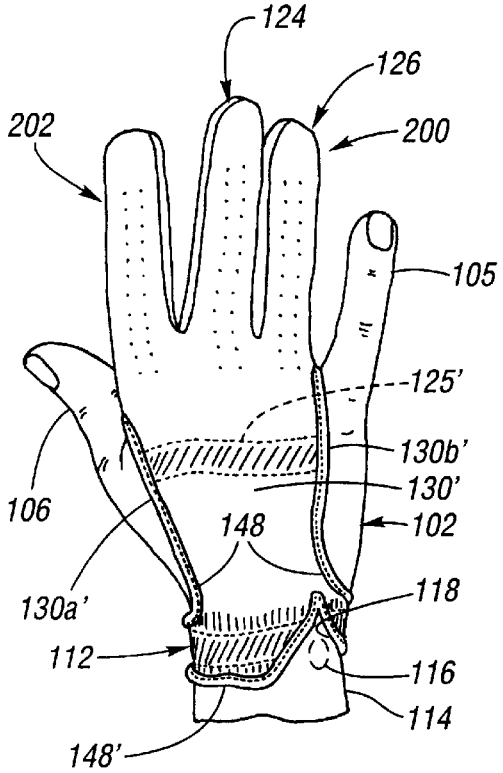
FIG. 8 is an anterior plan view of a second embodiment of the palmless golf glove, shown being worn on a right hand.
Figure 9:
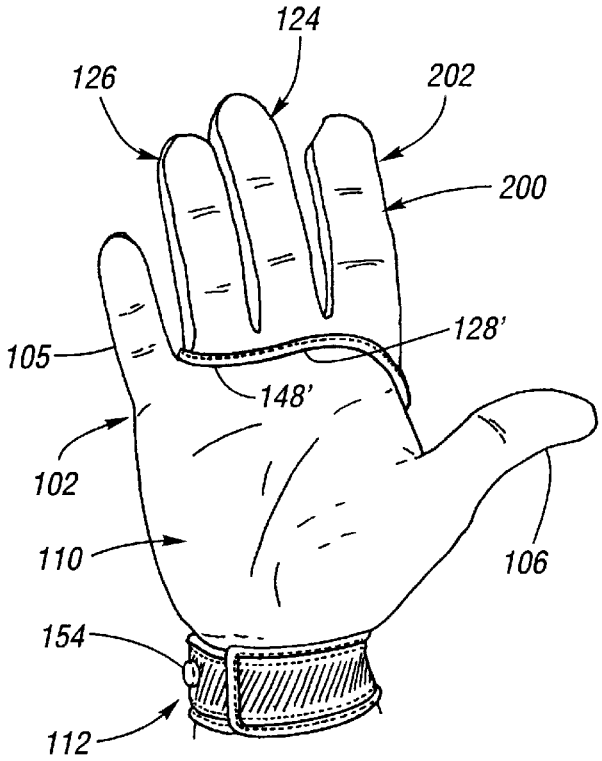
FIG. 9 is a posterior plan view of the second embodiment of the palmless golf glove, shown being worn on a right hand.
Figure 10:
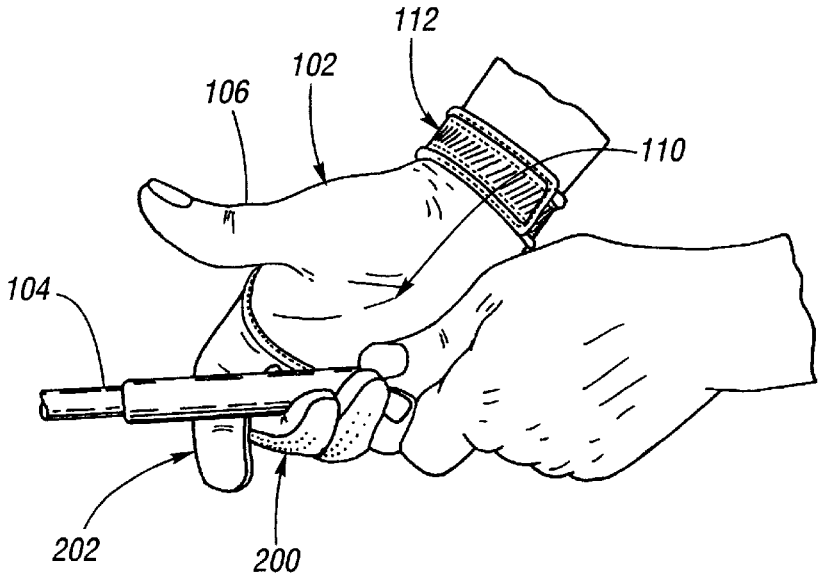
FIG. 10 is a perspective view of the second embodiment of the palmless golf glove being worn on a right hand (the left hand being bare), wherein shown is an intermediate stage of operation with respect to grippage of a golf club.

Operationally, as can be discerned from reference to FIGS. 5, 6 and 7, the golfer first places his or her second and third fingers into the second and third finger receptacles 124, 126. Next, the wrist band 112 is wrapped around the wrist so that the two free ends are brought together by the two component releasable fastener 150, whereupon the palmless golf glove 100 is now ready for use with a golf club 104 in a comfortable and familiar manner. The golfer need not be concerned with rubbing of the golf club against his or her second and third fingers, while at the same time the golfer feels every sensation of the golf club against his/her exposed thumb and first finger, and the exposed palm senses the top of his or her left thumb (wherein the exposed fourth finger lays on top of the golfer's left first finger). With concentration of the golfer focused on the swing, the palmless golf glove 100 provides assured control by not being subject to slippage, and the feel of the golf club quite discernible, the golfer can hit the golf ball as hard and as true as is possible within the physical limits of his/her skill.

Figure 11:
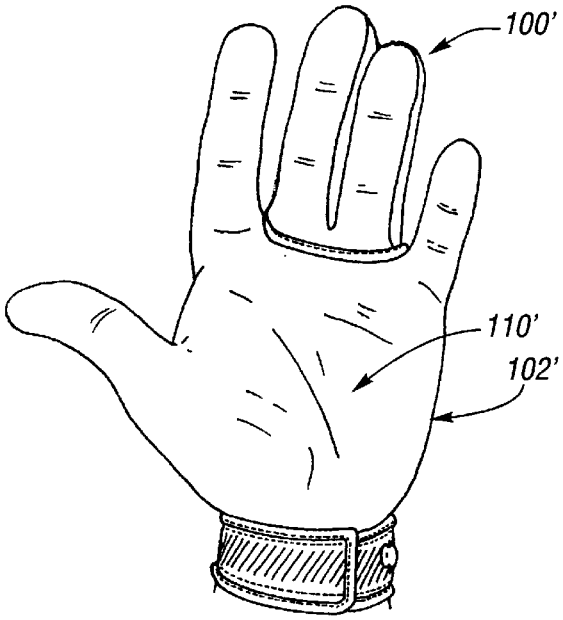
FIGS. 11 and 12 show posterior and anterior plan views of the first embodiment of the palmless golf glove, shown being worn on a left hand.
Figure 12:
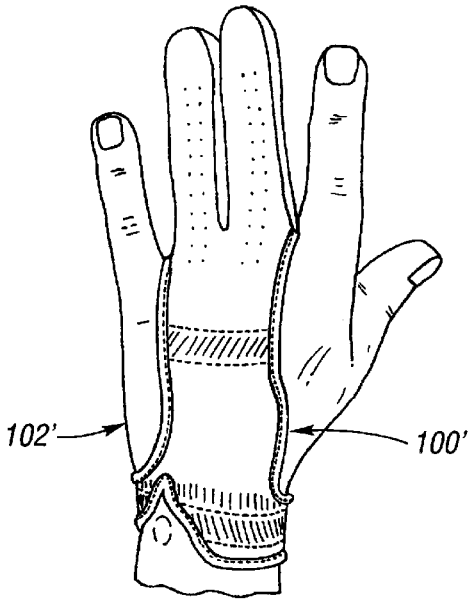

FIGS. 11 and 12 depict a left hand palmless golf glove 100' being worn on a left hand 102' of a left handed golfer and having the same structural and functional details as respectively recounted hereinabove for its right hand counterpart (ie., palmless golf glove 100).

The first embodiment of the palmless golf glove 100, 100' is primarily intended for the right hand of right handed golfers, and for the left hand of left handed golfers.

Turning attention now to FIGS. 8 through 10 and 13 through 25, variations of the preceding description will be described for second, third and fourth embodiments of the palmless golf glove 200, 200', 300, 300', 400, 400'. The construction details are essentially the same as those above recounted for the first embodiment of the palmless golf glove 100, 100' and, where like numerals are indicated similarly or similarly with primes, like functioning parts to those parts previously recounted are depicted. Accordingly, for the sake of brevity these like functioning parts do not require repetition of the attendant details in view of the extensive description already presented.

Turning attention now to FIGS. 8 through 10, 13 and 14, a variation of the preceding description will be described for a second embodiment of the palmless golf glove 200, 200'. The construction details are essentially the same as those above recounted for the first embodiment of the palmless golf glove 100, 100', wherein a significant departure from the foregoing description pertains to a first finger receptacle 202 of the palmless glove 200. The construction of the first finger receptacle 202 is like that for the second and third finger receptacles 124, 126. The hem 148' extends along the basal terminus 128' and the sides 130*a*', 130*b*' of the body section 130'. The body section 130' is widened to accommodate the first finger receptacle 202, and preferably includes the elastic material 125'. The wrist band 112 is as described hereinabove without modification, inclusive of the two component releasable fastener, the notch 118, and, preferably, the golf ball marker button 154.

In operation of the glove body 200, the golfer places his/her first, second and third fingers into the respective first, second and third finger receptacles 202, 124, 126, and then secures the two component releasable fastener of the wrist band so that the wrist band securely engirds the wrist. The user then uses the palmless golf glove 200 to swing a golf club 104. In this case, the benefits of exposed palm, fourth finger and thumb continue, and the first finger of the golfer is now also protected from chaffing.

Figure 13:
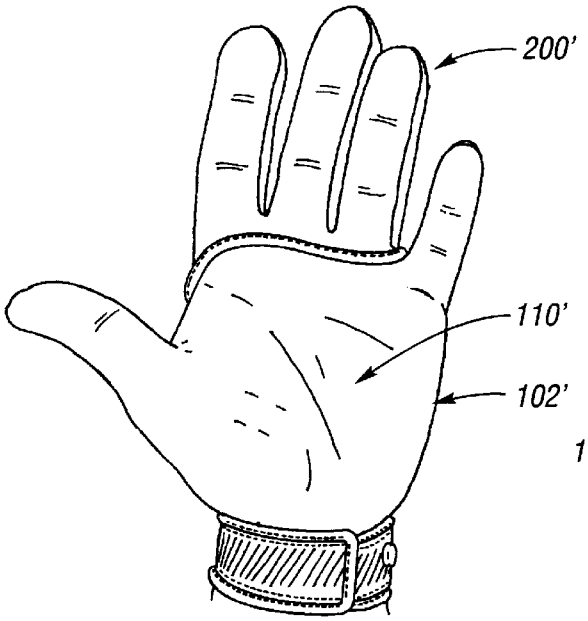
FIGS. 13 and 14 show posterior and anterior plan views of the second embodiment of the palmless golf glove, shown being worn on a left hand.
Figure 14:
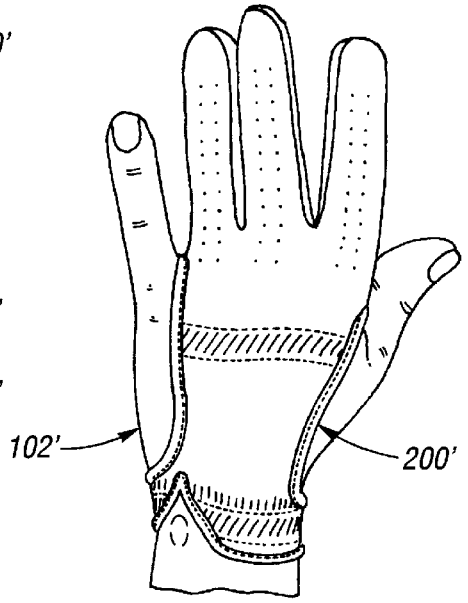
Figure 15:
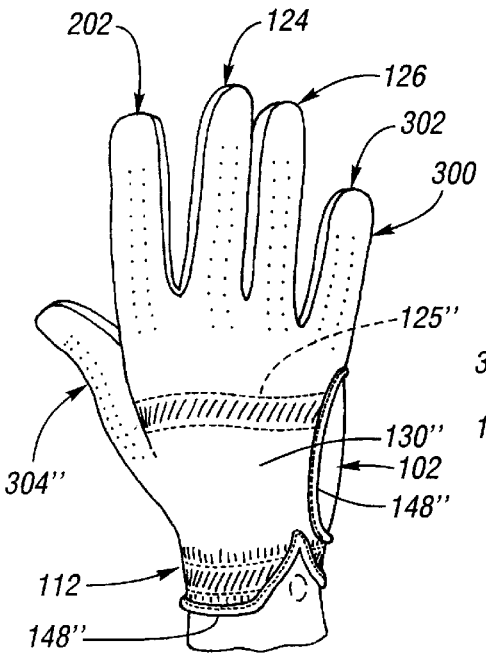
FIGS. 15 and 16 show anterior and posterior plan views of a third embodiment of the palmless golf glove, shown being worn on a right hand.
Figure 16:
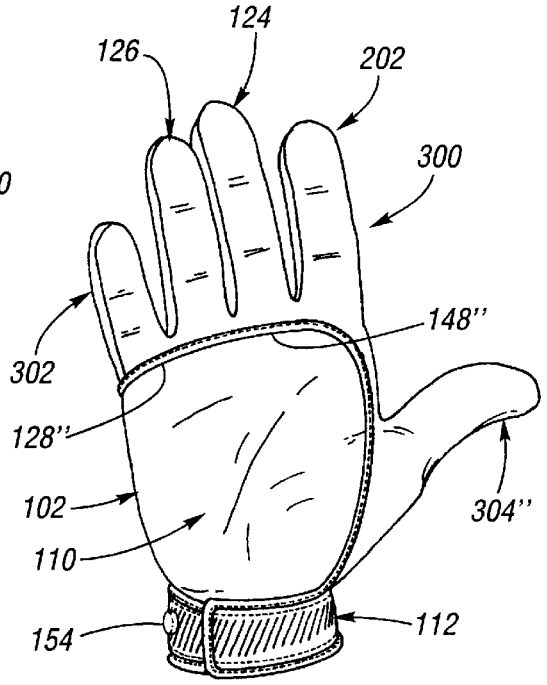
Figure 17:
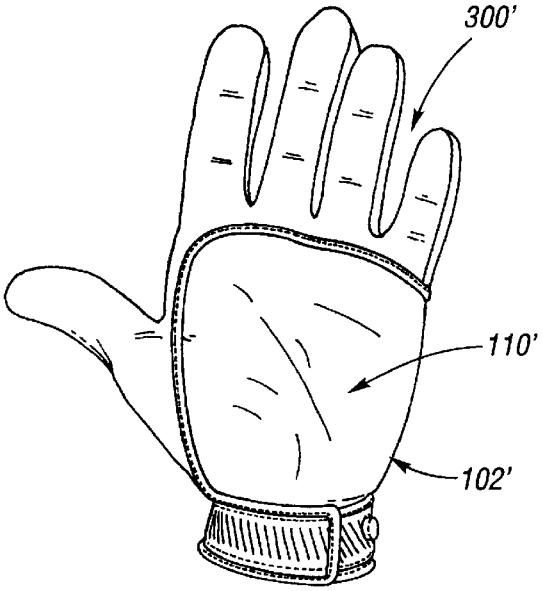
FIGS. 17 and 18 show posterior and anterior plan views of the third embodiment of the palmless golf glove, shown being worn on a left hand.
Figure 18:
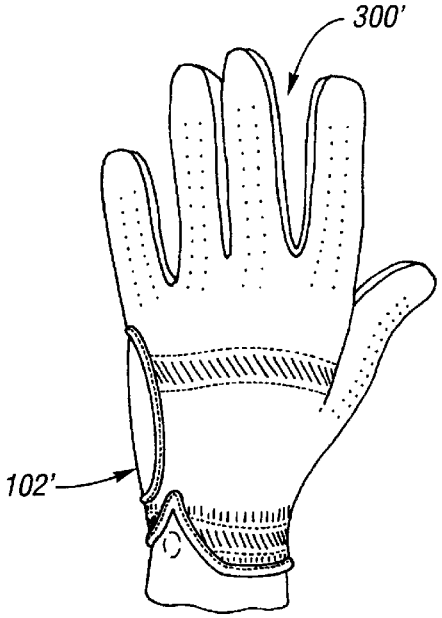
Figure 19:
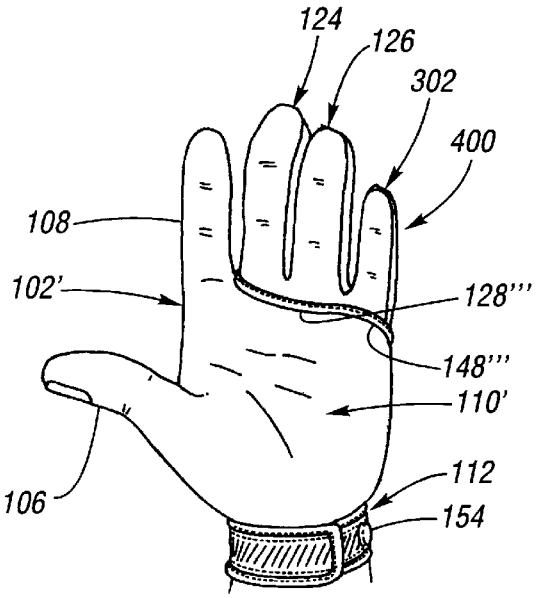
FIGS. 19 and 20 show posterior and anterior plan views of a fourth embodiment of the palmless glove, shown being worn on a left hand.
Figure 20:
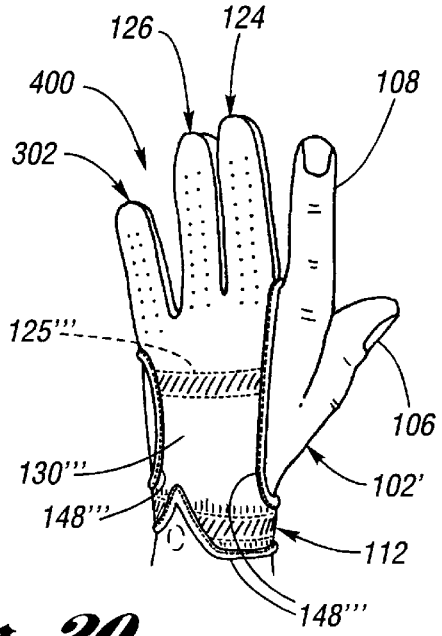
Figure 21:
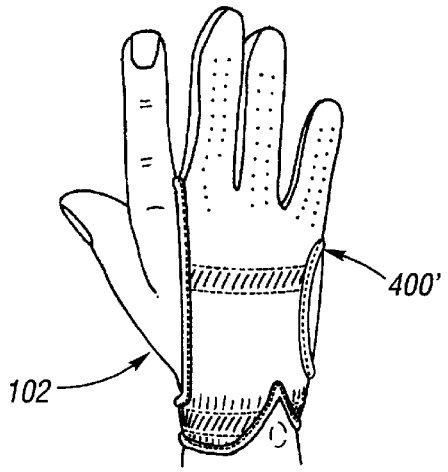
FIGS. 21 and 22 show anterior and posterior plan views of a fourth embodiment of the palmless glove, shown being worn on a right hand.
Figure 22:
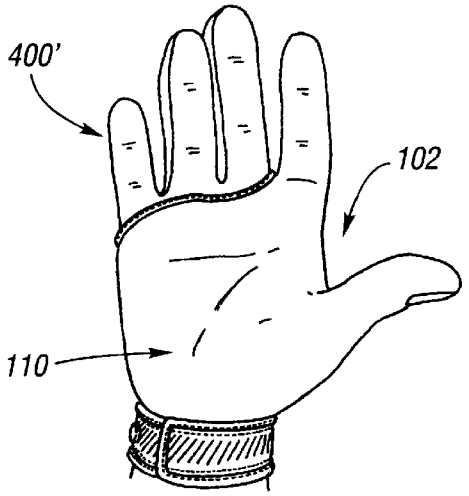

FIGS. 13 and 14 depict a left hand palmless golf glove 200' being worn on a left hand 102' of a left handed golfer and having the same structural and functional details as respectively recounted hereinabove for its right hand counterpart (ie., palmless golf glove 200).

The second embodiment of the palmless golf glove 200, 200' is primarily intended for the right hand of right handed golfers, and for the left hand of left handed golfers.

Turning attention now to FIGS. 15 through 18, a third embodiment of the palmless glove 300, 300' is depicted, wherein provided are finger receptacles 202, 124, 126, 302 for all four fingers as well as a thumb receptacle 304 for receiving the thumb. The basal terminus 128", now extends across all four finger receptacles and extends across the thumb receptacle. As clearly visible at FIGS. 16 and 17, the palm 110 of the golfer's hand remains completely exposed. The glove body 130" is similarly constructed as recounted hereinabove, although wider (now covering essentially the entire back of the hand), and preferably including the elastic material 125", and hem the 148". The wrist band 112 is connected with the glove body and is provided with the same features as recounted hereinabove, preferably including a golf ball marker button 154.

Turning attention now to FIGS. 19 through 22, a fourth embodiment of the golf glove 400, 400' is depicted, wherein provided are finger receptacles 124, 126, 302 for the second, third and fourth fingers, respectively. The palm 110, first finger 108 and the thumb 106 are fully exposed. The basal terminus 128'" now extends across the second, third and fourth finger receptacles. The glove body 130", is similarly constructed as recounted hereinabove, and preferably includes the elastic material 125" and the hem 148". The wrist band 112 is connected with the glove body and is provided with the same features as recounted hereinabove, preferably including a golf ball marker button 154.

The third and fourth embodiments of the palmless golf glove 300, 300', 400, 400' are primarily intended for the left hand of right handed golfers, and for the right hand of left handed golfers.

Figure 23:
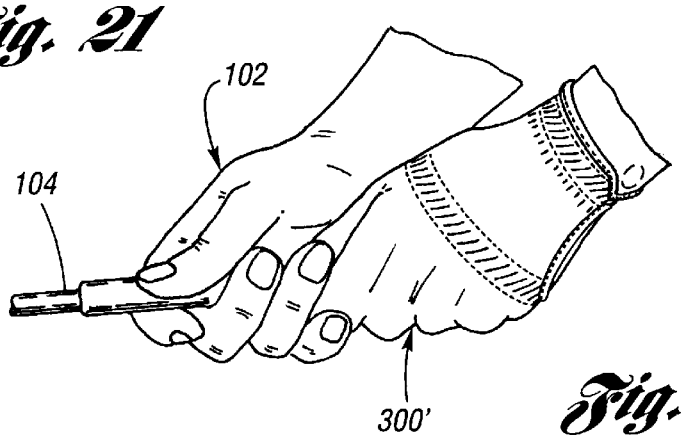
FIG. 23 is a perspective view of the third embodiment of the palmless golf glove shown worn on the left hand of a right handed golfer whose right hand is bare, wherein operation is shown with respect to grippage of a golf club.

FIG. 23 depicts another preferred mode of operation of the palmless golf glove according to the present invention. Here, a right handed golfer is wearing the third embodiment of the palmless golf glove 300' on his/her left hand and is gloveless on the other hand while gripping a golf club 104.

Figure 24:
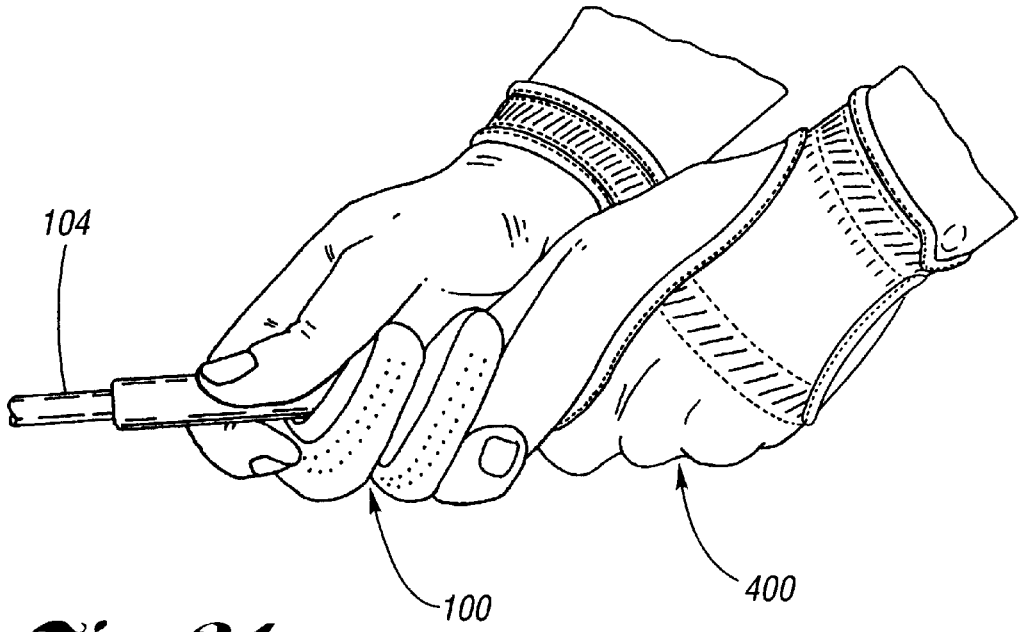
FIG. 24 is a perspective view of the first embodiment of the palmless golf glove shown worn on a right hand of a right handed golfer and of the fourth embodiment of the palmless golf glove shown worn on the left hand of the golfer, wherein operation is shown with respect to grippage of a golf club.

FIG. 24 depicts yet another preferred mode of operation of the palmless golf glove according to the present invention. Here, a right handed golfer is wearing the first embodiment of the palmless golf glove 100 on his/her right hand and wearing the fourth embodiment of the palmless golf glove 400 on his/her left hand while gripping a golf club 104.

Figure 25:
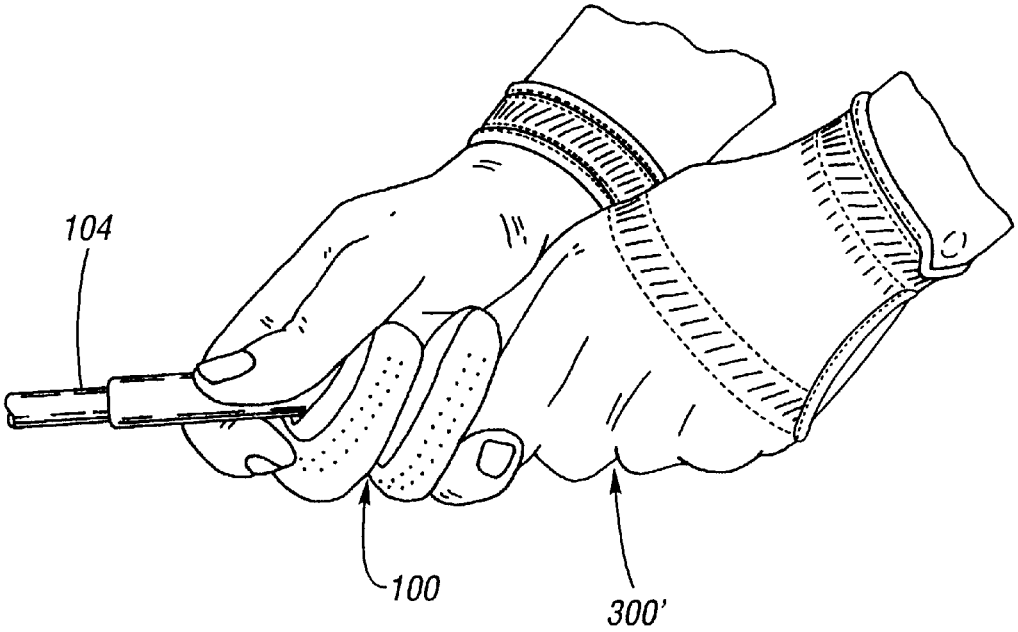
FIG. 25 is a perspective view of the first embodiment of the palmless golf glove shown worn on a right hand of a right handed golfer and of the third embodiment of the palmless golf glove shown worn on the left hand of the golfer, wherein operation is shown with respect to grippage of a golf club.

FIG. 25 depicts still another preferred mode of operation of the palmless golf glove according to the present invention. Here, a right handed golfer is wearing the first embodiment of the palmless golf glove 100 on his/her right hand and wearing the third embodiment of the golf glove 300' on his/her left hand while gripping a golf club 104.

It is to be understood that the second embodiment of the palmless golf glove 200 may be worn in the manner of the first embodiment of the palmless golf glove 100 in combination with the third and fourth embodiments of the palmless golf glove 300', 400 per the depiction at FIGS. 24 and 25. Further, it is to be understood that any of the palmless golf gloves 100, 100', 200, 200', 300, 300', 400, 400' may be worn singly (ie., without a glove on the other hand) or in combination with any other palmless glove or any other glove.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A glove comprising:

a plurality of finger receptacles having an anterior side and an opposite posterior side, said plurality of finger receptacles terminating at a basal terminus at the anterior side thereof;

a glove body having an upper end and an opposite lower end, said upper end being connected to said anterior side of said plurality of finger receptacles;

a wrist band connected with said lower end of said glove body; and releasable fastener means for selectively adjusting said wrist band from an open configuration to a selectively engirding configuration;

wherein the length of the glove body between the upper and lower ends thereof generally defines a separation distance between the wrist band and the basal terminus, such that when the glove is worn on a hand having first, second, third and fourth fingers, a thumb, a palm and a wrist, the basal terminus is located immediately adjacent the palm such that the palm and the thumb are substantially entirely exposed.

2. The glove of claim 1, wherein said wrist band has a notch; wherein when the glove is worn on the hand the styloid process of the wrist of the hand is exposed at the notch.

3. The glove of claim 1, wherein said plurality of finger receptacles comprises two finger receptacles.

4. The glove of claim 3, wherein one finger receptacle of the two finger receptacles is for receiving therein the second finger of the hand, and wherein the other finger receptacle of the two finger receptacles is for receiving the third finger of the hand.

5. The glove of claim 4, wherein the glove is structured so that the thumb, first finger and fourth finger of the hand are substantially entirely exposed when the glove is worn on the hand.

6. The glove of claim 5, wherein said wrist band has a notch; wherein when the glove is worn on the hand the styloid process of the wrist of the hand is exposed at the notch.

7. The glove of claim 1, wherein said plurality of finger receptacles comprises three finger receptacles.

8. The glove of claim 7, wherein one finger receptacle of the three finger receptacles is for receiving therein the first finger of the hand, another finger receptacle of the three finger receptacles is for receiving the second finger of the hand, and yet another finger receptacle of the three finger receptacles is for receiving the third finger of the hand.

9. The glove of claim 8, wherein the glove is structured so that the thumb and fourth finger of the hand are substantially entirely exposed when the glove is worn on the hand.

10. The glove of claim 9, wherein said wrist band has a notch; wherein when the glove is worn on the hand the styloid process of the wrist of the hand is exposed at the notch.

11. The glove of claim 7, wherein one finger receptacle of the three finger receptacles is for receiving therein the second finger of the hand, another finger receptacle of the three finger receptacles is for receiving the third finger of the hand, and yet another finger receptacle of the three finger receptacles is for receiving the fourth finger of the hand.

12. The glove of claim 11, wherein the glove is structured so that the thumb and first finger of the hand are substantially entirely exposed when the glove is worn on the hand.

13. The glove of claim 12, wherein said wrist band has a notch; wherein when the glove is worn on the hand the styloid process of the wrist of the hand is exposed at the notch.

14. A method for providing protection for selected fingers of the hands of a golfer, wherein a primary hand of the golfer is defined as the right hand of a right handed golfer and further defined as the left hand of a left handed golfer, and wherein a secondary hand of the golfer is defined as the left hand of a right handed golfer and further defined as the right hand of a left handed golfer, said method comprising the steps of:

placing a first finger receptacle onto a first selected finger of a selected hand of the primary and secondary hands so as to entirely cover the first selected finger;

placing a second finger receptacle onto a second selected finger of the selected hand so as to entirely cover the second selected finger; and securing the first and second finger receptacles with respect to the wrist of the selected hand, while leaving exposed the palm and the thumb of the selected hand.

15. The method of claim 14, wherein the selected hand is the primary hand, and wherein said step of securing secures the first and second finger receptacles to the wrist of the primary hand, while further leaving exposed the thumb, first finger, and fourth finger of the primary hand; wherein said first and second steps of placing comprise:

placing the first finger receptacle onto the second finger of the primary hand; and placing the second finger receptacle onto the third finger of the primary hand.

16. The method of claim 15, further comprising the steps of:

placing a third finger receptacle onto the second finger of the secondary hand;

placing a fourth finger receptacle onto the third finger of the secondary hand;

placing a fifth finger receptacle onto the fourth finger of the secondary hand; and securing the third, fourth and fifth finger receptacles with respect to the wrist of the secondary hand, while leaving exposed the palm, first finger and thumb of the secondary hand.

17. The method of claim 14, wherein the selected hand is the primary hand, and wherein said step of securing secures the first and second finger receptacles to the wrist of the primary hand; wherein said first and second steps of placing comprise:

placing the first finger receptacle onto the first finger of the primary hand; and placing the second finger receptacle onto the second finger of the primary hand;

said method further comprising the step of placing a third finger receptacle onto the third finger of the primary hand;

wherein said step of securing further secures the third finger receptacle to the wrist of the primary hand; wherein said step of securing further leaves exposed the thumb and fourth finger of the primary hand.

18. The method of claim 17, further comprising the steps of:

placing a fourth finger receptacle onto the second finger of the secondary hand;

placing a fifth finger receptacle onto the third finger of the secondary hand;

placing a sixth finger receptacle onto the fourth finger of the secondary hand; and securing the fourth, fifth and sixth finger receptacles with respect to the wrist of the secondary hand, while leaving exposed the palm, thumb and first finger of the secondary hand.

19.The method of claim 14, wherein the selected hand is the secondary hand, and wherein said step of securing secures the first and second finger receptacles to the wrist of the secondary hand; wherein said first and second steps of placing comprise:

placing the first finger receptacle onto the second finger of the secondary hand; and placing the second finger receptacle onto the third finger of the secondary hand;

said method further comprising the step of placing a third finger receptacle onto the fourth finger of the secondary hand;

wherein said step of securing further secures the third finger receptacle with respect to the wrist of the secondary hand; wherein said step of securing further leaves exposed the thumb and first finger of the secondary hand.

20. A glove comprising:

a plurality of finger receptacles having an anterior side and an opposite posterior side, said plurality of finger receptacles terminating at a basal terminus at the anterior side thereof;

a glove body having an upper end and an opposite lower end, said upper end being connected to said anterior side of said plurality of finger receptacles;

a wrist band connected with said lower end of said glove body; and releasable fastener means for selectively adjusting said wrist band from an open configuration to a selectively engirding configuration;

wherein the length of the glove body between the upper and lower ends thereof generally defines a separation distance between the wrist band and the basal terminus, such that when the glove is worn on a hand having first, second, third and fourth fingers, a thumb, a palm and a wrist, the basal terminus is located such that the palm is substantially entirely exposed;

wherein said wrist band has a notch; and wherein when the glove is worn on the hand the styloid process of the wrist of the hand is exposed at the notch.

* * * * *